United States Patent [19]

Rose et al.

[11] Patent Number: 4,599,497

[45] **Date of Patent: * Jul. 8, 1986**

[54] SINGLE AND DUAL IN-LINE PACKAGE SWITCH

[75] Inventors: William H. Rose; David T. Shaffer; Philip J. Walker, all of Harrisburg, Pa.

[73] Assignee: AMP Incorporated, Harrisburg, Pa.

[ * ] Notice: The portion of the term of this patent subsequent to Jan. 2, 2002 has been disclaimed.

[21] Appl. No.: 677,116

[22] Filed: Nov. 30, 1984

Related U.S. Application Data

[63] Continuation-in-part of Ser. No. 671,537, Nov. 15, 1984, which is a continuation of Ser. No. 485,549, Apr. 15, 1983, Pat. No. 4,496,802.

[51] Int. Cl.[4] ..... H01H 5/18

[52] U.S. Cl. ..... 200/5 R; 200/6 R; 200/67 DB

[58] Field of Search ..... 200/67 DB, 339, 67 DA, 200/5 A, 5 R, 6 R

[56] References Cited

U.S. PATENT DOCUMENTS

| | | | |
|---|---|---|---|
| 3,067,301 | 12/1962 | Yamamoto | 200/67 DB |
| 3,548,131 | 12/1970 | Piber | 200/275 X |
| 3,699,296 | 10/1972 | Harris | 200/67 DB |
| 3,809,839 | 5/1974 | Beddoe | 200/160 |
| 4,059,737 | 11/1977 | Gergaud | 200/159 A X |
| 4,417,106 | 11/1983 | Gingerich et al. | 200/6 R X |
| 4,496,802 | 1/1985 | Rose et al. | 200/5 R |

FOREIGN PATENT DOCUMENTS

| | | | |
|---|---|---|---|
| 2110002A | 6/1983 | United Kingdom | 200/6 R |

*Primary Examiner*—A. D. Pellinen
*Assistant Examiner*—Morris Ginsburg
*Attorney, Agent, or Firm*—Adrian J. LaRue; Anton P. Ness

[57] ABSTRACT

An electrical switch comprises a dielectric housing along one side of which movable electrical contact members are disposed. A stationary electrical contact is disposed along the other side of the dielectric housing. Each of the movable contact members has a curved contact section, one end of the contact section being secured in the dielectric housing as a terminal section while the free end of the contact section is disposed within a recess of an actuating member pivotally mounted on the housing with actuating sections of the actuating members being operable from one surface of the housing to one position thereby moving the curved contact sections in electrical engagement with the stationary contact and to another position thereby moving the curved contact sections free of the stationary contact, the spring forces of the curved contact sections maintaining the actuating members and the contact sections in the one or the other position. The housing includes at one switch position an arrangement to maintain one of the movable contact members in electrical engagement with the stationary contact.

10 Claims, 17 Drawing Figures

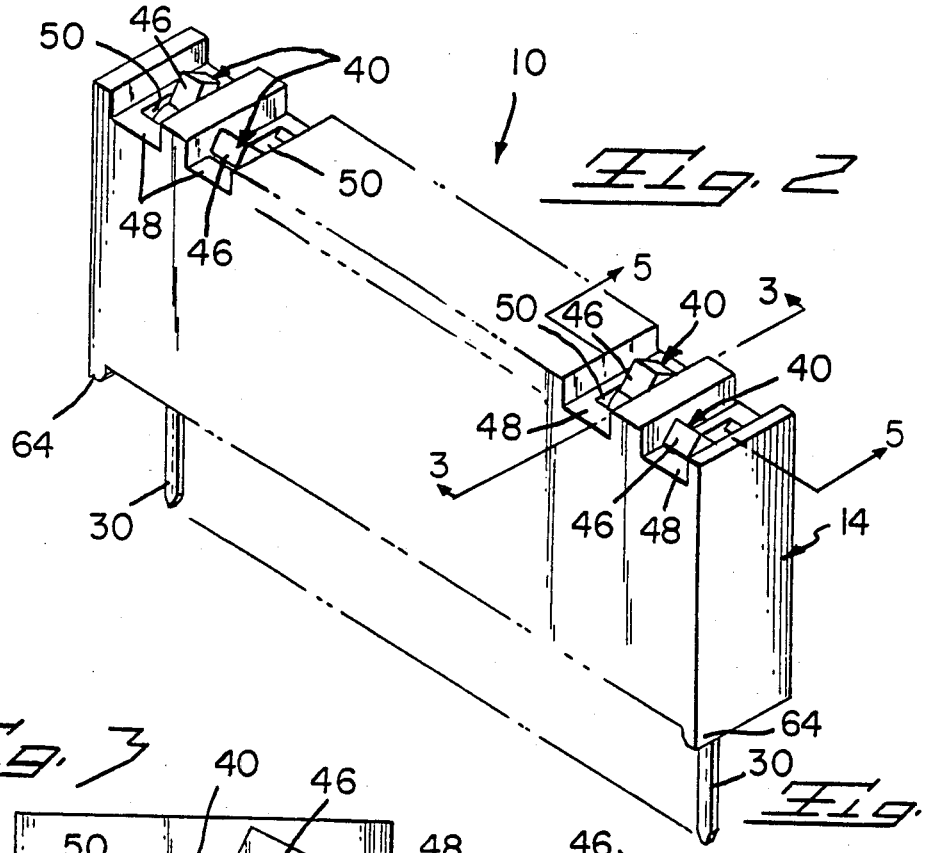
Fig. 2
Fig. 3
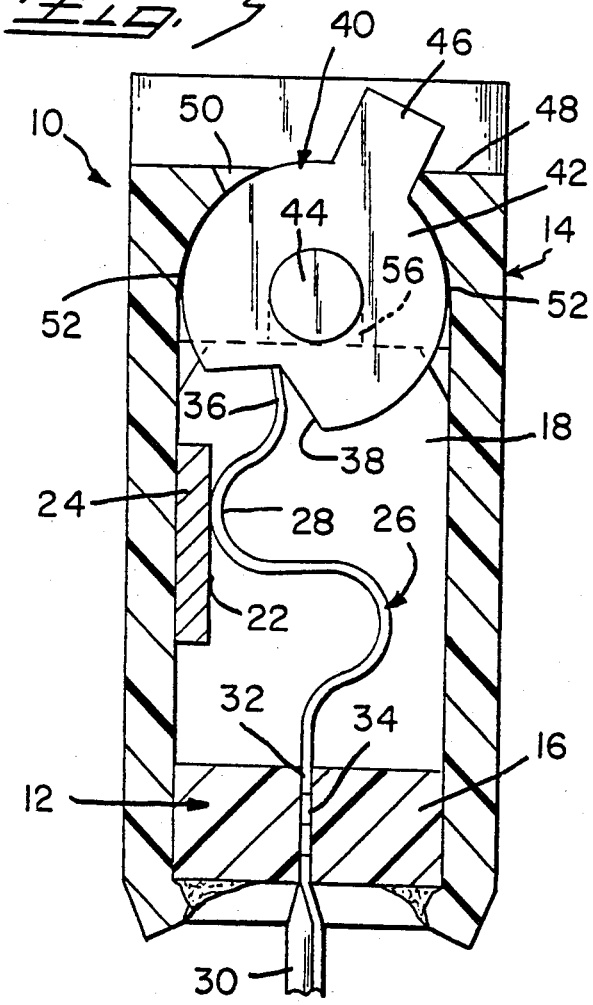
Fig. 4
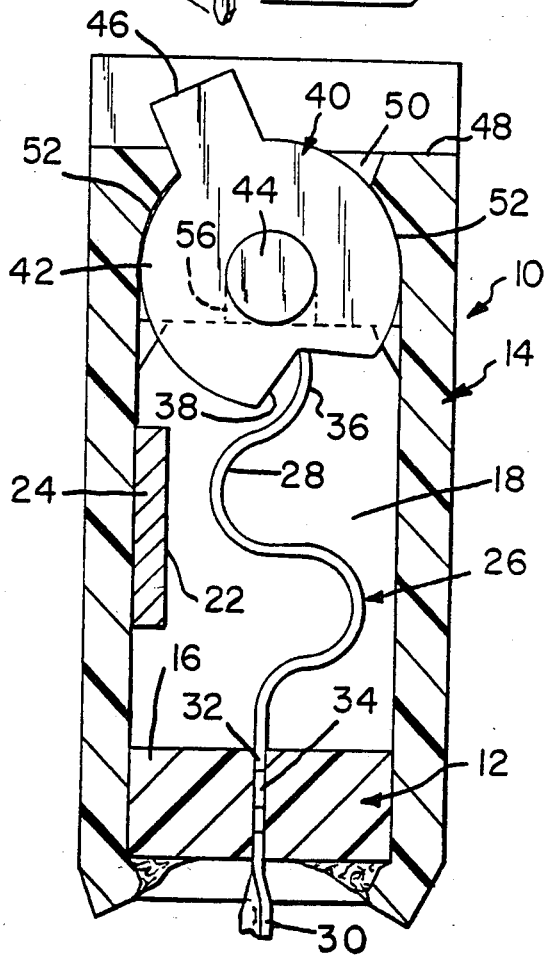

WITH ALL POSITIONS OPEN HEX 1 1 1 0 1 1 1 1 EF

WITH POSITION 4 CLOSED HEX 1 1 1 0 1 1 1 1 EF

WITH POSITIONS 5,4,2 & 0 CLOSED HEX 1 1 0 0 1 0 1 0 CA

WITH POSITIONS 7,4 & 2 CLOSED HEX 0 1 1 0 1 0 1 1 6B

Fig. 15
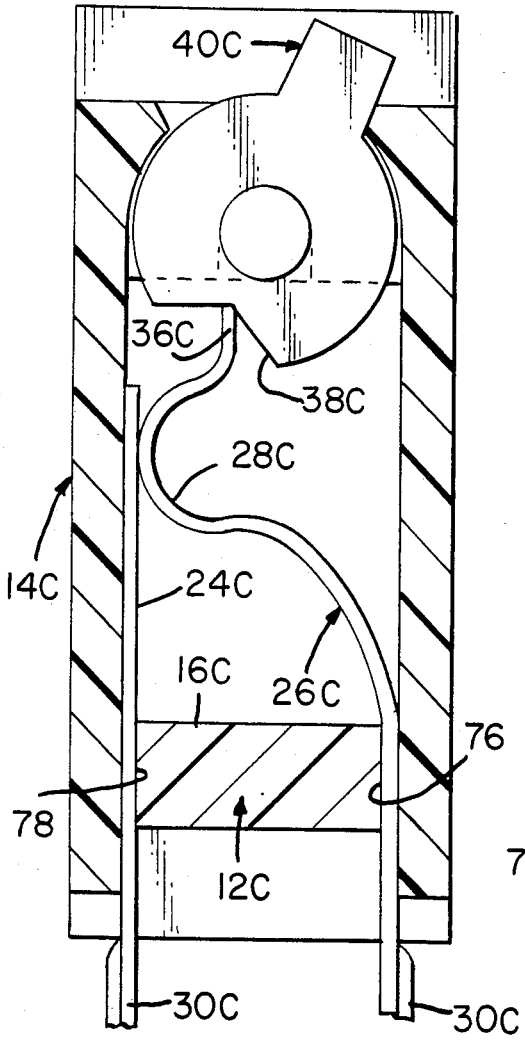
Fig. 16
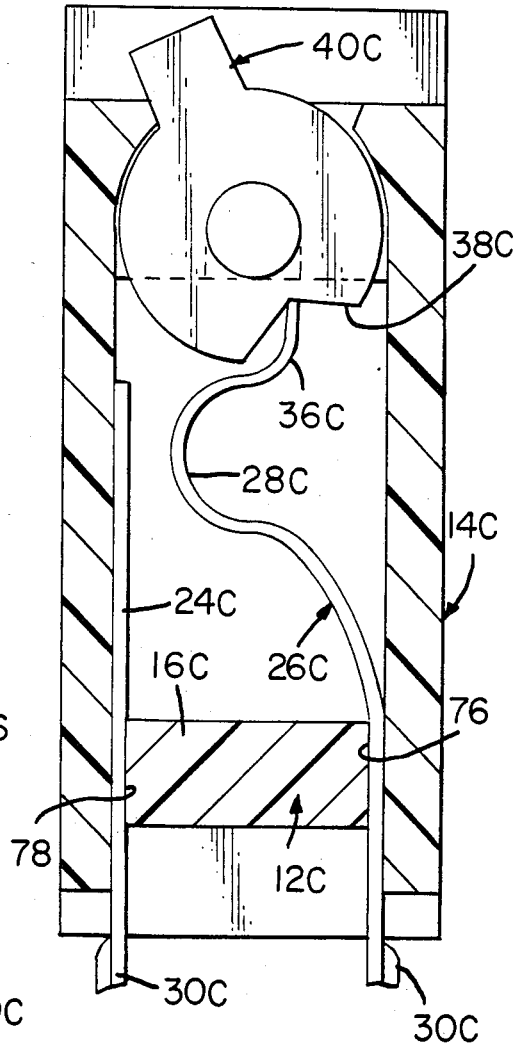
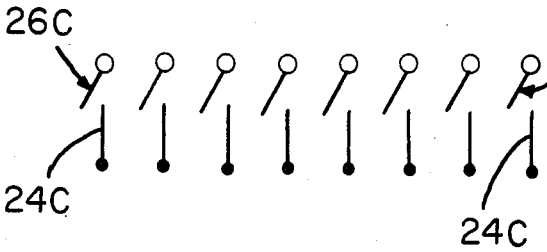
Fig. 17

SINGLE AND DUAL IN-LINE PACKAGE SWITCH

CROSS REFERENCE TO RELATED APPLICATION

This application is a continuation-in part application of U.S. patent application Ser. No. 671,537 filed Nov. 15, 1984 which is a continuation of Ser. No. 485,549, filed Apr. 15, 1983, now U.S. Pat. No. 4,496,802 issued Jan. 29, 1985.

FIELD OF THE INVENTION

This invention relates to switches and more particularly to single and dual in-line package (SIP and DIP) switches.

BACKGROUND OF THE INVENTION

At present, codes between integrated circuits on circuit boards can be changed by use of posts electrically connected to a ground plane and a voltage level. This is done when space on circuit boards is a problem and this problem is becoming prevalent by virtue of more components being utilized on circuit boards due to increasing demand for additional circuit requirements to perform more functions.

The use of posts does not present the most desirable way to the selection and changing of codes between the various integrated circuits as this is a cumbersome arrangement that uses electrical wires which must be mechanically and electrically connected to the posts and the selected pins of the integrated circuits. If the codes are to be changed, the wires must be reconnected so that the electronic circuits will operate as required.

Dual in-line package switches can be used when no space problems on the circuit boards exist; but if space is a problem, then a smaller switch with multiple actuating members would enable selection and changing of codes to be readily effected without the use of cumbersome posts and electrical wires as heretofore used.

SUMMARY OF THE INVENTION

According to the present invention, a single in-line package switch comprises a dielectric frame along which movable electrical contact members are disposed. A stationary electrical contact member is mounted on the dielectric frame, each of the movable contact members extending between a pair of the support members. Each of the movable contact members has a curved contact section, one end of the contact section being secured in the dielectric frame as a terminal section while the free end of the contact section is disposed within a recess of an actuating member pivotally mounted on the pair of support members between which the contact section is disposed. A housing member is secured onto the dielectric frame with actuating sections of the actuating members being operable from one surface of the housing member to one position thereby moving the sinusoidal contact sections in electrical engagement with the stationary contact member and to another position thereby moving the sinusoidal contact sections free of the stationary contact member, the spring forces of the sinusoidal contact sections maintaining the contact sections and the actuating members in the one or the other position.

According to another aspect of the present invention, one of the curved contact sections is maintained in electrical engagement with the stationary contact member by the housing member thereby commoning the stationary contact member without using one of the other movable contact members to apply a specified voltage thereto.

According to a further aspect of the present invention, a stationary contact member is disposed in operative alignment with a curved contact section of each movable contact member thereby forming a DIP switch.

BRIEF DESCRIPTION OF THE DRAWINGS

FIG. 2 shows the switch of FIG. 1 in an assembled form.

FIG. 3 is a cross-sectional view taken along line 3—3 of FIG. 2 showing one of the movable electrical contact sections of the switch in an actuated position.

FIG. 4 is a view similar to FIG. 3 showing the movable electrical contact section in a nonactuated position.

FIGS. 15 and 16 are cross-sectional views of a still further embodiment of the invention showing the switch as a DIP switch in operative and nonoperative positions.

FIG. 17 is a schematic diagram of the switch of FIGS. 15 and 16.

DETAILED DESCRIPTION OF THE INVENTION

FIGS. 1 through 5 illustrate the switch 10 which is a single in-line package (SIP) switch for use on circuit boards to allow codes to be easily set at the factory or in the field as required. Switch 10 includes a dielectric frame 12 and dielectric housing member 14. Dielectric frame 12 and dielectric housing member 14 are molded from a suitable plastic material.

Figure 1:
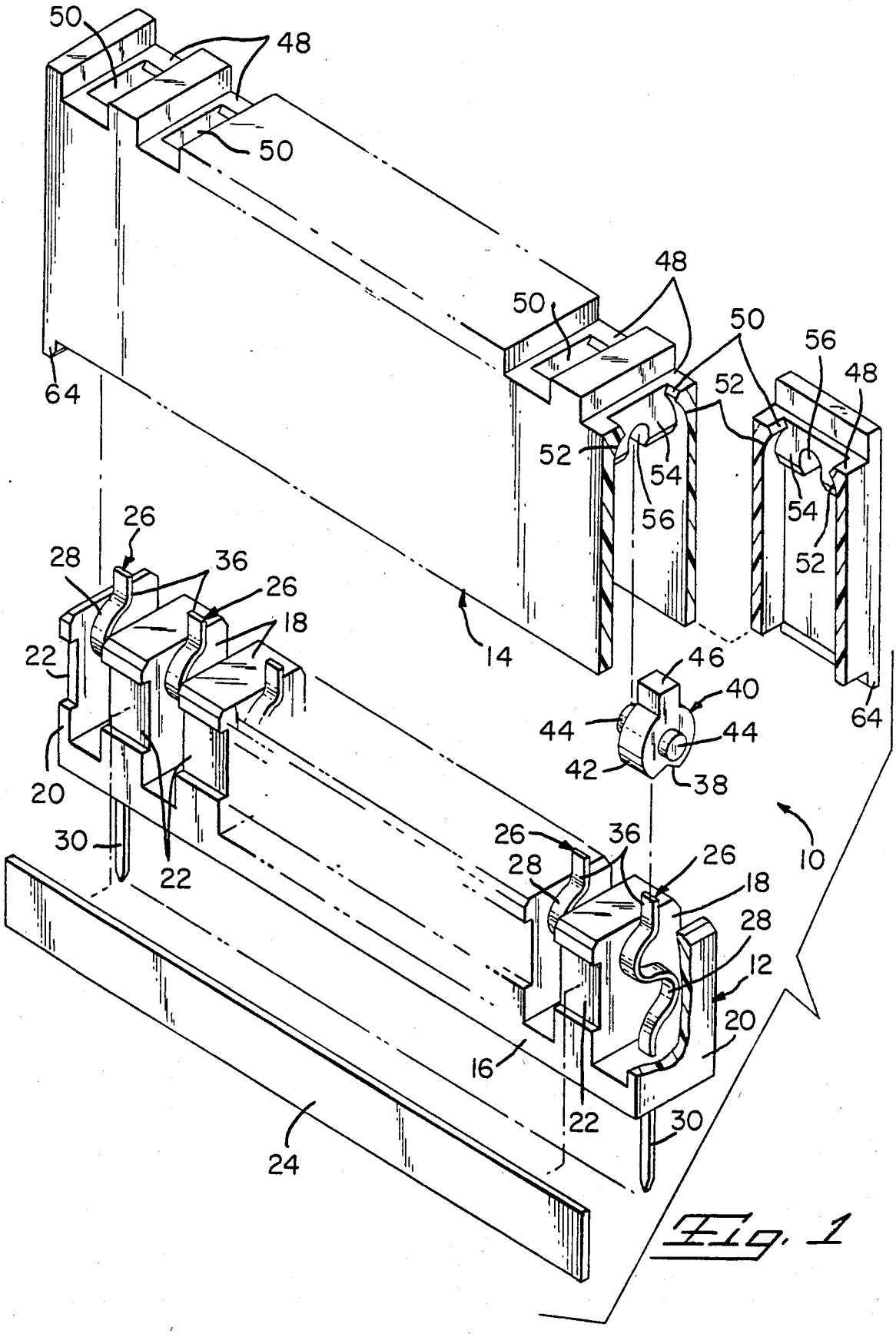
FIG. 1 is an exploded perspective view of the parts of the SIP switch with one of the parts having a broken away section and another of the parts being in cross section and the end exploded therefrom.
Figure 5:
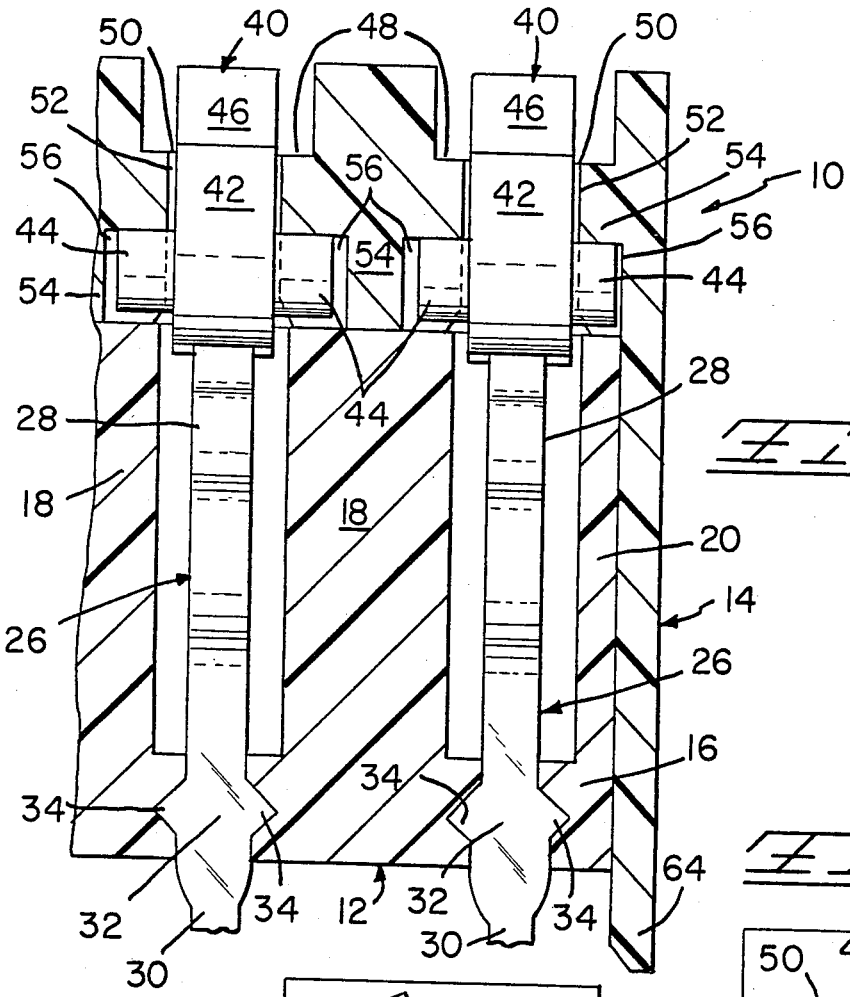
FIG. 5 is a cross-sectional view taken along line 5—5 of FIG. 2.

Dielectric frame 12 has a base 16 from which extend support members 18 at spaced intervals therealong. End support members 20 are thinner than support members 18 as shown in FIGS. 1 and 5. A recess 22 is located in each of support members 18 and 20. An electrical bus contact member 24 is disposed in recesses 22 of support members 18 and 20 and is held in position therein by means of housing member 14 as shown in FIGS. 3 and 4.

Movable electrical contact members 26 are stamped and formed from a suitable metal having desirable spring characteristics and include a contact section 28, a terminal section 30, and a securing section 32. Movable contact members 26 are molded in position within dielectric frame 12 between support members 18 and 20 via securing section 32 which includes triangular-shaped projections 34 which are best illustrated in FIG. 5 and which enhance the securing of movable contact members 26 in position in base 16 of dielectric frame 12 when they are molded in position during the molding of dielectric frame 12. Terminal sections 30 are formed so that they are slightly angularly bent with respect to securing sections 32 and they extend outwardly therefrom for electrical connection with conductive paths on a circuit board in accordance with normal flow-soldering practices or they can be secured in sockets electrically connected to the conductive paths as desired.

Contact sections 28 are of sinusoidal configuration or an S-shape or with double curved sections. One end of contact sections 28 extends outwardly from securing sections 32 whereas free ends 36 of contact sections 28 are disposed within notched areas 38 of actuating members 40. As can be discerned, free ends 36 are disposed at the apex of notched areas 38.

Actuating members 40 are molded from a suitable plastic material and have almost circular sections 42 in which notched areas 38 are located and from the sides of which extend circular pivot members 44. Projections 46 extend outwardly from circular sections 42 opposite notched areas 38.

Housing member 14 has a series of recesses 48 located in a top surface thereof. Slots 50 are located in the bottom surfaces of recesses 48 and communicate with the interior of housing member 14. As shown in FIGS. 1, 3, 4, and 6, the inside surfaces of housing member 14 have arcuate sections 52 that merge with the respective ends of slots 50 and along which circular sections 42 of actuating members 40 extend. Projections 54 extend inwardly from the top surface of housing member 14 in alignment with support members 18 and 20 and have arcuate recesses 56 therein to accommodate pivot members 44 of actuating members 40 enabling actuating members 40 to be pivotally moved thereabout.

In assembly, a lead frame (not shown) containing stamped and formed movable contact members 26 thereon is positioned in a mold whereafter dielectric frame 12 is molded therein with contact members 26 positioned between adjacent support members 18 and end support members 20 and adjacent support members 18. Bus contact member 24 can also be molded in position in dielectric frame 12 or it can be frictionally positioned within recesses 22 formed in support members 18 and 20. Housing member 14 is positioned in an upside-down position so that actuating members 40 are positioned in adjacent projections 54 with pivot members 44 disposed within arcuate recesses 56, circular sections 42 disposed in engagement with arcuate sections 52, and projections 46 extending through slots 50 within recesses 48. Dielectric frame 12 containing movable contact members 26 and bus contact member 24 therein is inserted within housing member 14 with the upper surfaces of support members 18 and 20 engaging against the bottom surfaces of respective projections 54 and with free ends 36 of movable contact members 26 disposed against the apexes within respective notched areas 38 of actuating members 40 whereafter heat is applied to the bottom edges of housing member 14 to deform them into engagement with base 16 as shown in FIGS. 3 and 4 thereby securing dielectric frame 12 in position in housing member 14.

Figure 6:
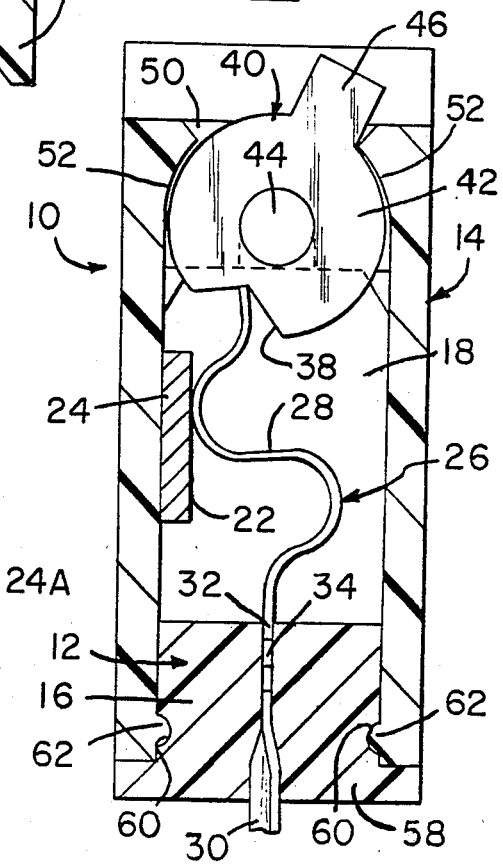
FIG. 6 is a cross-sectional view of an alternative embodiment.

If desired, as shown in FIG. 6, a T-shaped member 58 having recesses 60 in the sides thereof which are matable with projections 62 on the inside surfaces of housing member 14 is positioned in the bottom of housing member 14 thereby maintaining member 58 in position in housing member 14 and in turn engages base 16 of dielectric frame 12 thereby maintaining dielectric frame 12 in position in housing member 14. An adhesive, if desired, can be applied onto the sides of member 58 and along the adjacent surfaces thereby adhesively securing member 58 in position in housing member 14 as shown in FIG. 6. Projections 64 extend outwardly from base 16 at the ends of housing member 14 which engage the circuit board when switch 10 is inserted in position thereon to space switch 10 from the surface of the circuit board.

Figure 7:
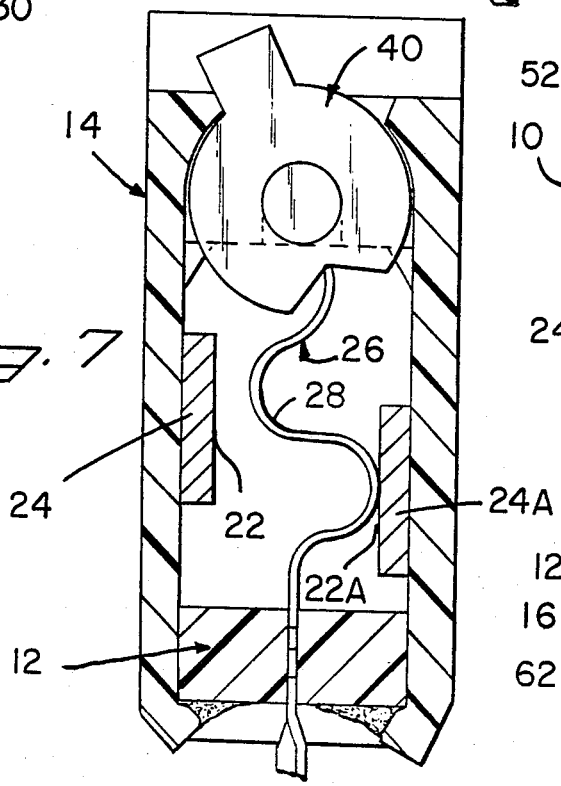
FIG. 7 is a cross-sectional view of a further embodiment.

When dielectric frame 12 is secured in position in housing member 14 with free ends 36 of movable contact members 26 disposed at the apexes of notched areas 38 of actuating members 40, the spring forces of contact sections 28 urge pivot members 44 against the bottoms of arcuate recesses 56 and also maintain actuating members 40 in either an actuated position as shown in FIG. 3 with a curved section of contact section 28 in electrical engagement with bus contact member 24 of in a nonactuated position as shown in FIG. 4 with contact section 28 completely free of engagement with bus contact member 24. Projections 46 enable an operator to move actuating members 40 to actuated or nonactuated positions. The action of double-curved contact sections 28 is such as to provide snap-action operation to actuating members 40 such that when projections 46 are moved beyond their center locations, they will snap into an actuated or nonactuated position depending upon which direction actuating members 40 are being moved and free ends 36 are disposed on either side of the center positions in accordance with the positions of actuating members 40. Accordingly, if projections 46 do not move beyond their center positions, they will return to the positions they were located in as a result of the spring forces of contact sections 28. The spring forces of contact sections 28 act eccentrically on actuating members 40 to maintain them in actuated or nonactuated positions. The pivot points of contact sections 28 are located along the bottom curved portions. Thus, the switch as illustrated in FIGS. 1 through 6 is either in the actuated or nonactuated position depending upon the positions of actuating members 40. If desired, another bus contact member 24A can be disposed in recesses 22A in support members 18 and 20 opposite the bottom curved sections of contact sections 28 to enable switch 10 to be able to operate between two voltage levels if necessary as shown in FIG. 7.

Figure 8:
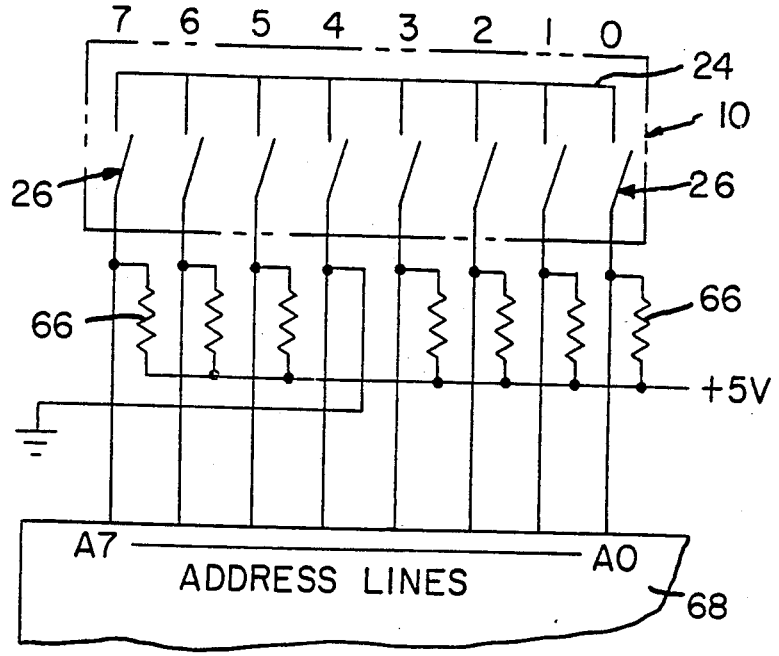
FIGS. 8 through 11 are schematic diagrams illustrating several codes that can be established by use of the SIP switch.

FIG. 8 shows a SIP switch 10 that has its movable contact members 26 electrically connected to respective address lines A0 through A7 of a circuit board 68. Movable contact members 26 representing switch positions 0, 1, 2, 3, 5, 6, and 7 are respectively connected to a +5 voltage via resistors 66 and the movable contact member representing position 4 is connected to ground. With all of the switch positions open, the code being generated to the address lines will be 1 1 1 0 1 1 1 1 as shown in FIG. 8.

Figure 9:
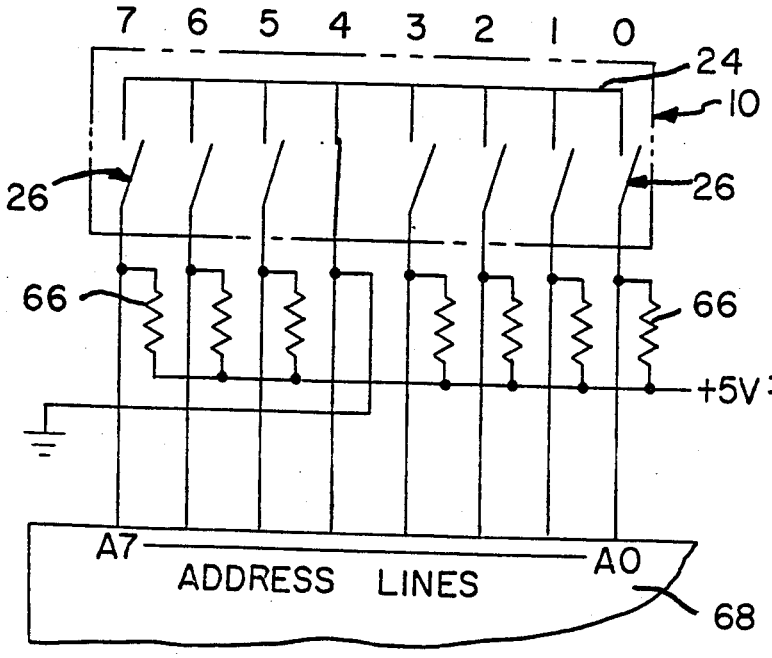
Figure 10:
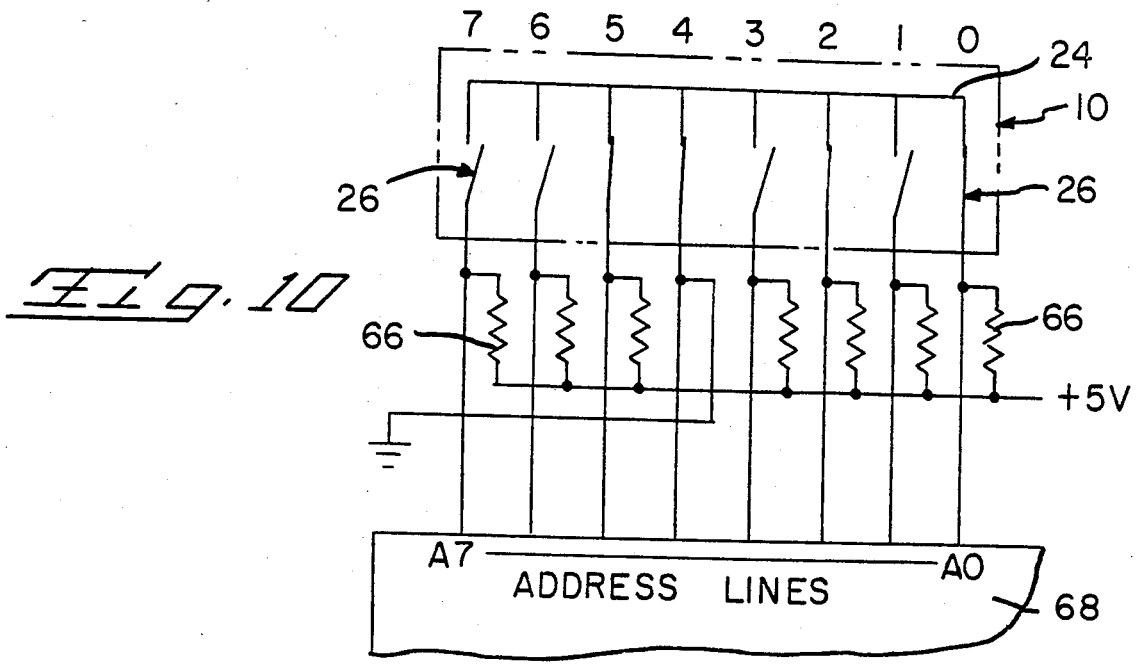
Figure 11:
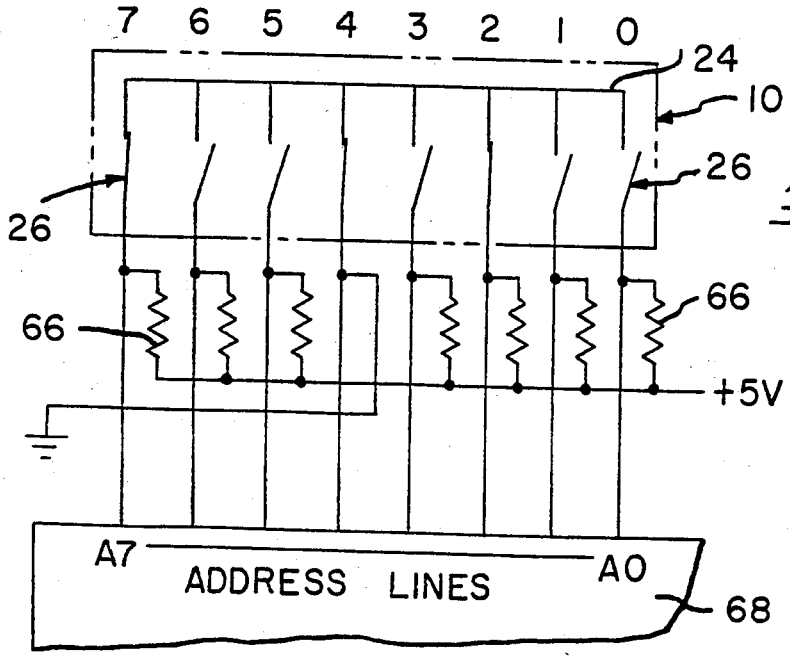

As shown in FIG. 9, with position 4 of switch 10 closed with movable contact member 26 electrically connected to bus contact 24, the code being sent out to address lines A0 through A7 will be 1 1 1 0 1 1 1 1. As shown in FIG. 10, with movable contact members 26 in positions 5, 4, 2, and 0 electrically connected to bus contact 24, the code being generated over address lines A0 through A7 will be 1 1 0 0 1 0 1 0. As shown in FIG.

11, with movable contact members 26 electrically connected to bus contact 24 in positions 7, 4, and 2, the code appearing on address lines A0 through A7 will be 0 1 1 0 1 0 1 1. Thus, FIGS. 8 through 11 are representative of some of the codes that can be established by use of SIP switch 10. An eight-position SIP switch will enable 128 codes to be selected.

The SIP switch of the present invention allows the code to be easily set at the factory or in the field as required. This enables on-board option selection where extreme density problems on boards are being experienced. The bottom of the switch is sealed by virtue of the movable contact members 26 being molded in position in frame 12 and with base 16 being heat-staked in position in housing member 14. Top sealing can take place by applying a peelable sealing material along the top surface of housing member 14 which extends into recesses 48 and slots 50 surrounding projections 46 and circular sections 42. SIP switch 10 is of small size, can be stackable in end-to-end relationship, and may be machine insertable onto circuit boards.

The SIP switch of FIGS. 1–11 uses a switch position to connect stationary contact member 24 to ground or a selected voltage level for the other switch positions. This can create a problem because the switch position that performs this function can be inadvertently switched to a nonoperative position or accidentally switched to a nonoperative position.

Figure 12:
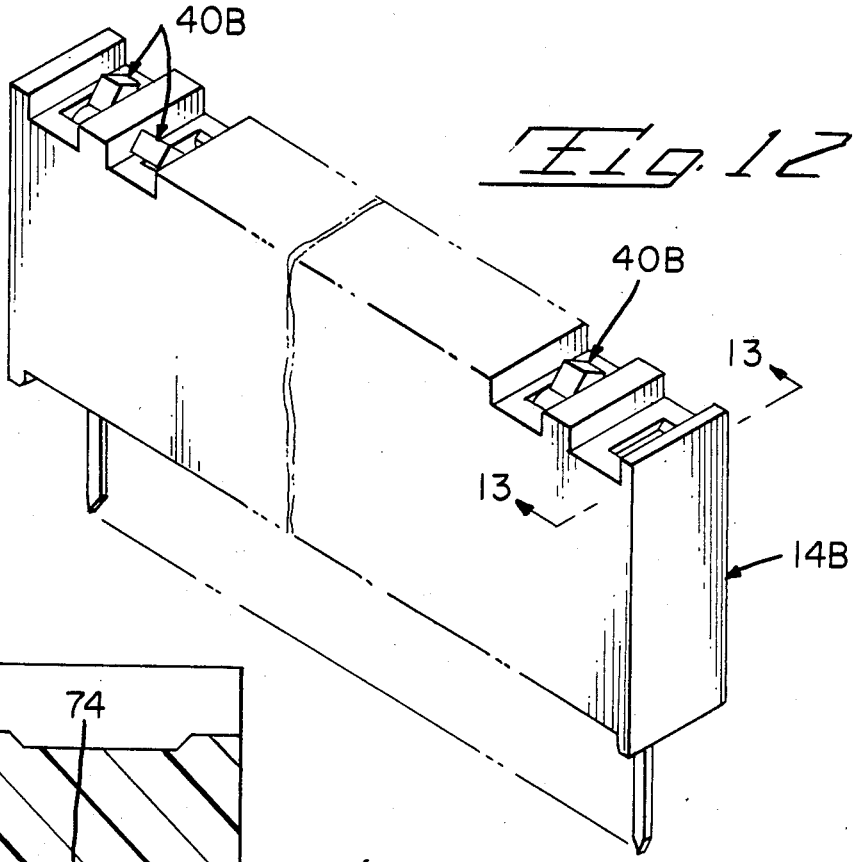
FIG. 12 is a perspective view of another embodiment of the switch of FIG. 1.
Figure 13:
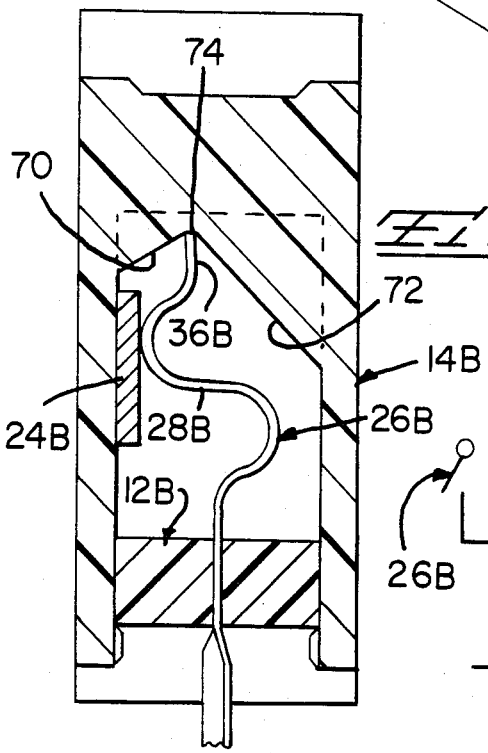
FIG. 13 is a cross-sectional view taken along line 13—13 of FIG. 12.
Figure 14:
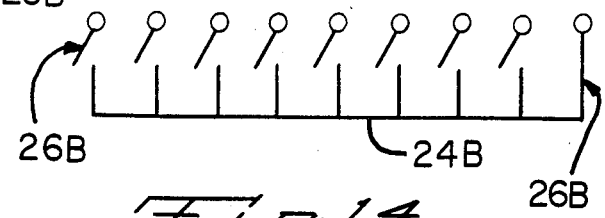
FIG. 14 is a schematic diagram of the switch of FIGS. 12 and 13.

The embodiment of FIGS. 12–14 overcomes this situation by the use of an additional switch position added to the other switch positions. Housing member 14B has inclined merging surfaces 70 and 72 that are in alignment with movable contact member 26B. Surface 70 is shorter than surface 72 so that the apex 74 is off center as shown. Free end 36B of movable contact member 26B is positioned in apex 74 when housing member 14B is secured to frame 12B because surface 72 moves free end 36B thereinto. Thus, the curved contact section 28B of movable contact member 26B at this switch position is maintained in electrical engagement with contact member 24B at all times so that this movable contact member is now nonmovable and contact member 24B is therefore always connected to ground or a selected voltage level as shown in FIG. 14. Thus, when actuating members 40B are moved to move respective curved contact sections 28B of movable contact members 26B into electrical engagement with stationary contact member 24B, these movable contact members will be connected to ground or some selected voltage level without using any of the movable switch positions to establish the voltage level of stationary contact member 24B.

FIGS. 15–17 illustrate a DIP switch embodiment of the present invention. At each switch position, movable contact members 26C have their curved contact sections 28C in operative alignment with a respective stationary contact member 24C. Curved contact sections 28C also curved sections of larger radius than that of the curved contact sections 28C which curve back toward base 16C of dielectric frame 12C and they further have straight sections as part of terminal sections 30C disposed in respective slots 76 in one side of base 16C so that movable contact members 26C are secured in position between base 16C and an inside surface of a side wall of housing member 14C. Free ends 36C of movable contact members 26C are disposed in notched areas 38C of actuating members 40C.

Stationary contact members 24C extend along an inside surface of the other side wall of housing member 14C and are disposed in respective slots 78 in the other side of base 16C. Slots 78 are in alignment with respective slots 76 so that movable contact sections 28C of movable contact members 26C are in operative alignment with respective stationary contact members 24C. Terminal sections 30C of both movable contact members 26C and stationary contact members 24C extend outwardly from housing member 14C for electrical engagement with respective conductive paths of a printed circuit or multilayer board.

Stationary contact members 24C can be a single contact member as shown in FIGS. 13–14 with a single terminal section to connect it to ground or a selected voltage level; or one of the movable contact members can establish the voltage level of the single stationary contact member in the form of a bus with no terminal section or sections. Or, another switch position with inclined surfaces 70,72 as shown in FIG. 13 can be provided in housing member 14C thereby maintaining the additional movable contact member 26C in electrical engagement with the stationary contact member establishing a ground or selected voltage level for the stationary contact member.

As shown in FIGS. 15 and 16, actuating members 40C in one position maintain curved contact sections 28C in electrical engagement with respective stationary contact members 24C, and, in the other position, actuating members 40C maintain curved contact sections 28C out of engagement with stationary contact members 24C. The spring forces exerted by movable contact sections 28C on actuating members 40C maintain the actuating members and respective movable contact sections in the actuated or nonactuated positions. The free ends 36C are offset with respect to the longitudinal central axis of housing member 14C in the actuated or nonactuated positions.

We claim:

1. An electrical switch, comprising:

a dielectric housing along which a plurality of contact members are located in actuating alignment with stationary electrical contact means;

actuating means movably mounted in said dielectric housing and associated with respective movable ones of said contact members;

each of said movable contact members has a curved contact section;

said actuating means when moved to one position moving the respective movable contact section into electrical engagement with said stationary contact means, said actuating means when moved to another position moving the respective movable contact section free of the stationary contact means; and means provided by a selected one of said contact members and said housing maintaining the contact section of said selected contact member in continuous electrical engagement with said stationary contact means.

2. An electrical switch as set forth in claim 1, wherein said stationary contact means is a bus contact means.

3. An electrical switch as set forth in claim 2, wherein said maintaining means comprises inclined surfaces provided by said housing that form an off center apex in which a free end of said selected contact member is disposed.

4. An electrical switch as set forth in claim 1, wherein said actuating means have notched areas, said curved contact sections have free ends disposed in the notched areas of the respective actuating means, the spring forces of the curved contact sections maintaining said actuating means in the one or the other position.

5. An electrical switch as set forth in claim 1, wherein said housing includes a dielectric frame having spaced support members between which said movable contact members are mounted, said stationary contact means being mounted on said support members.

6. An electrical switch, comprising:

a dielectric housing having a series of movable electrical contact members disposed along one side of the housing and a series of stationary electrical contact members disposed along another side of the housing in operating alignment with respective movable contact members, said movable contact members having curved contact sections for electrical engagement with respective stationary contact members;

actuating members movably mounted in said housing and associated with respective said movable contact members; and free ends of said curved contact sections disposed in engagement with said actuating members, said curved contact sections applying spring forces onto said actuating members, said spring forces maintaining said actuating members in one position with the curved contact sections in electrical engagement with the stationary contact members, and upon actuation of said actuating members said spring forces maintaining said actuating members in another position with said curved contact sections out of engagement with the stationary contact members, said maintaining in said one position and in said other position occurring without said movable contact members being stressed into a different shape.

7. An electrical switch as set forth in claim 6, wherein said curved contact sections have sections that curve back to said housing which have a radius much larger than that of said curved contact sections.

8. An electrical switch as set forth in claim 6, wherein said housing includes a dielectric frame having opposed slots along respective sides in which the movable and stationary contact members are disposed as aligned stationary and movable contact members.

9. An electrical switch as set forth in claim 8, wherein said frame has spaced support members between which are disposed respective aligned stationary and movable contact members.

10. An electrical switch as set forth in claim 9, wherein said housing has projections provided with arcuate recesses in alignment with said support members, said actuating members having pivot members disposed in said arcuate recesses.

* * * * *